United States Patent [19]

Suzuki

[11] Patent Number: 5,074,352

[45] Date of Patent: Dec. 24, 1991

[54] METHOD FOR MANUFACTURING CERAMIC REINFORCED PISTON

[75] Inventor: Nobuyuki Suzuki, Shizuoka, Japan

[73] Assignee: Kabushiki Kaisha A. M. Technologies, Shizuoka, Japan

[21] Appl. No.: 538,673

[22] Filed: Jun. 13, 1990

Related U.S. Application Data

[63] Continuation of Ser. No. 276,853, Nov. 28, 1988, abandoned.

[30] Foreign Application Priority Data

Nov. 28, 1987 [JP] Japan ..... 62-301024
Dec. 26, 1987 [JP] Japan ..... 62-198486

[51] Int. Cl.[5] ..... B22D 19/00

[52] U.S. Cl. ..... 164/97; 164/98; 164/120

[58] Field of Search ..... 164/97, 98, 120, 319-321

[56] References Cited

U.S. PATENT DOCUMENTS 3,068,539 12/1962 Wilcoxon ..... 164/320
4,592,405 6/1986 Allen ..... 164/120
4,667,727 5/1987 Barlow et al. ..... 164/120
4,804,033 2/1989 Hepworth et al. ..... 164/97

*Primary Examiner*—Richard K. Seidel
*Assistant Examiner*—Edward A. Brown
*Attorney, Agent, or Firm*—Wenderoth, Lind & Ponack

[57] ABSTRACT

A method for manufacturing a ceramic reinforced piston and a molding machine therefor. A composite product composed of a cast product made of aluminum alloy or the like and shaped inorganic short fiber, particles or the like is obtained so that mechanical strength, wear resistance, heat resistance and the like of such composite product can be increased. Furthermore, mass production of such composite products becomes possible. A suitable amount of ceramic particles or a shaped inorganic short fiber is introduced in a casting mold, a molten metal such as an aluminum alloy and the like is then poured in the casting mold, and an upper punch is suitably pushed down on the molten metal to pressurize such molten metal in the casting mold. Push rams are additionally introduced laterally into the mold before or during the pouring of the molten metal to compensate for any shortage of molten metal and assure the metal penetrates the particles of fiber. The metal solidifies under pressure. The concave portions produced by the push rams correspond to the location of the piston pin cavity, and thus do not adversely affect the piston.

1 Claim, 2 Drawing Sheets

FIG. 1 - PRIOR ART
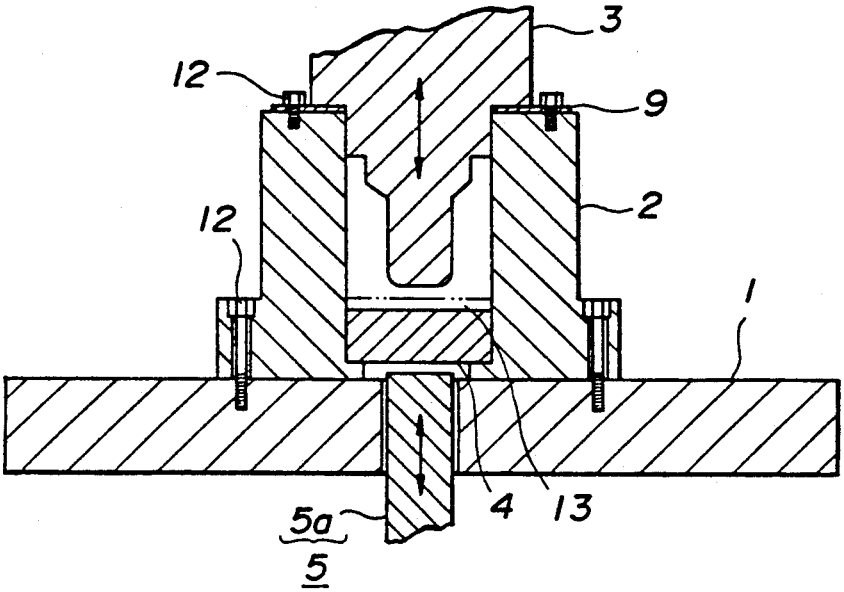
FIG. 2
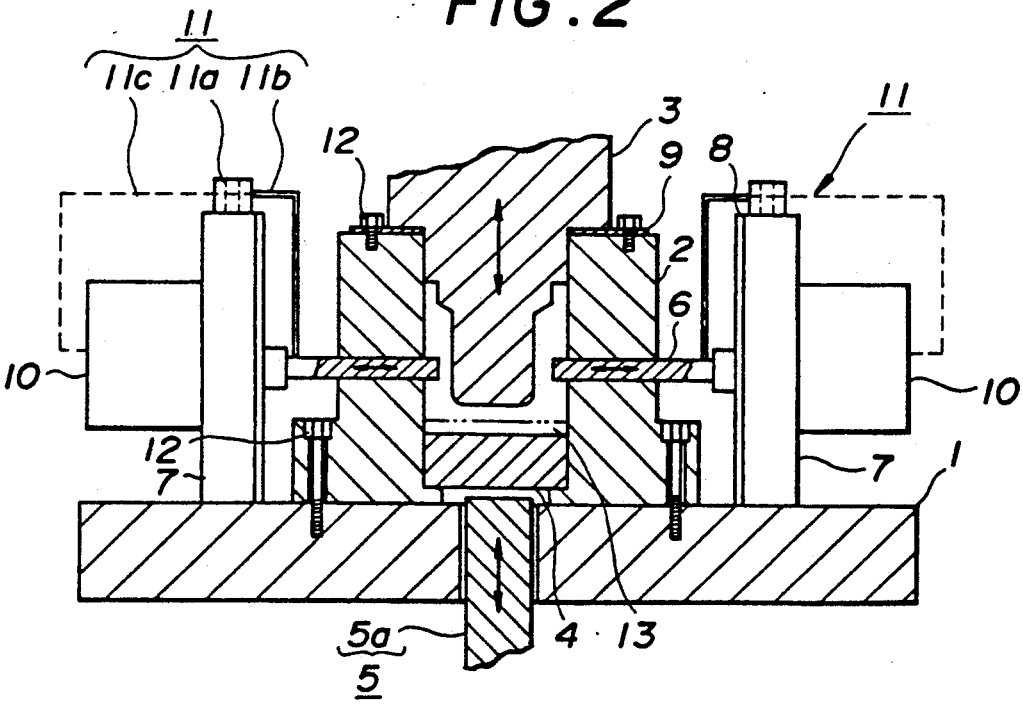

FIG. 3 - PRIOR ART
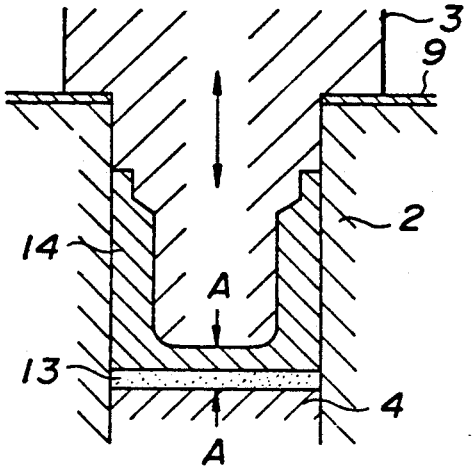
FIG. 4
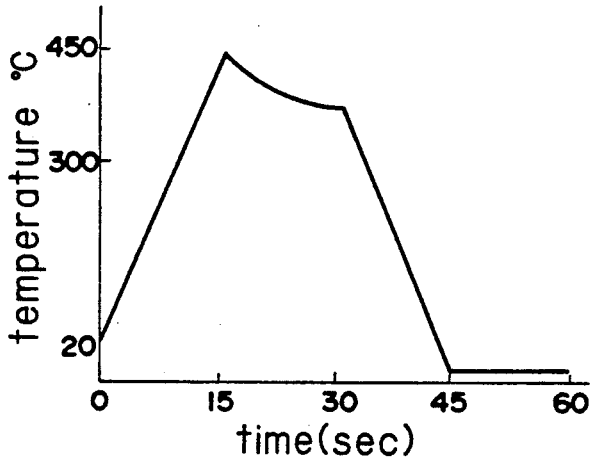
FIG. 5
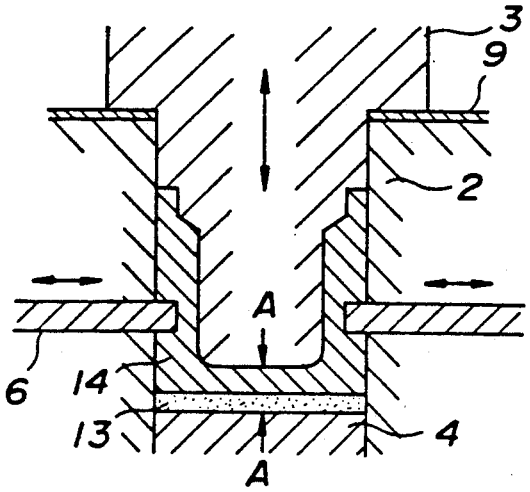

METHOD FOR MANUFACTURING CERAMIC REINFORCED PISTON

This application is a continuation of now abandoned application, Ser. No. 07/276,853, filed Nov. 28, 1988 now abandoned.

TECHNICAL FIELD

The present invention relates to a method for manufacturing a ceramic reinforced piston and a casting machine therefor by which a composite product composed of a cast product made of an aluminum alloy or the like and shaped inorganic short fiber, particles or the like is obtained so that mechanical strength, wear resistance, heat resistance and the like of such composite product can be increased, and mass production thereof becomes possible.

BACKGROUND OF THE INVENTION

Heretofore, there are disclosed the techniques with respect to a method for manufacturing a ceramic reinforced piston as enumerated hereinbelow.

In Japanese Patent Laid-open No. 128832/1977, there is described a method for manufacturing a cast product exhibiting thermal insulation properties in which a composite product is prepared from at least a part of a shaped inorganic fiber and an aluminum or magnesium alloy cast product in accordance with either a high pressure solidification casting method or a combined use of a high pressure casting method and a gravity casting method. Furthermore, in Japanese Patent Laid-open No. 93560/1983, there is disclosed a method for manufacturing a fiber composite alloy metallic material in which a fiber product is shaped so as to conform to a site upon which reinforcement is desired as well as a site which is to be cut out after its working, the resulting shaped fiber product is set at a prescribed position in a metallic mold, and then casting is effected. Moreover, there is described in Japanese Patent Application No. 22457/1987, proposed by the present inventor, a method for manufacturing a fiber reinforced composite product in which a number of cohered balls of an inorganic short fiber material which have been previously prepared are combined and formed into a predetermined shape by the use of a binder, the resulting formed material is set at a predetermined position in a casting mold, and a molten metal is poured thereinto to cast the product. In Japanese Patent Application No. 270032/1987, also proposed by the present inventor, there is disclosed a method for manufacturing a fiber reinforced composite casting product in which a shaped product having a predetermined shape is obtained from an inorganic short fiber material which has been previously deposited in the horizontal direction by the use of a binder, the resulting shaped product is set at a prescribed position in a casting mold, and then a molten metal such as an aluminum alloy or the like is poured in said casting mold thereby effecting casting.

However, the above described conventional manufacturing methods and the machines therefor relate to, as shown in FIGS. 1 and 3, such a manufacturing method wherein ceramic particles or a shaped inorganic short fiber product (13) has been previously placed at a prescribed position in a casting mold defined by a heated mold main body (2) and a heated knock-out die (4), a molten metal (14) is poured in the interior of the casting mold, whereby the molten metal (14) such as aluminum alloy or the like is caused to penetrate into the shaped product (13) while applying a pressure by means of an upper punch (3), and the molten metal is solidified to partially reinforce only the crown surface of a piston. According to this method, however, variation in a thickness A—A of the crown surface arises dependent upon slight scattering of the molten metal (14) poured. When the amount of the molten metal poured is short, pressure of the molten metal (14) is reduced so that internal defects, such as incomplete penetration of the molten metal (14) into the shaped product (13) placed in the crown surface portion, appearance of blowholes inside the resulting product and the like, easily occur. In these circumstances, such conventional methods as described above have been practiced in such a manner that, for the sake of avoiding the internal defects as described above, a somewhat larger amount of the molten metal is used to form a thicker crown thickness A—A than the prescribed thickness, and thereafter the resulting crown thickness is reduced by means of machine work to finally obtain a predetermined thickness of the crown surface. Such cutting of a crown surface in these conventional methods tends to cut out a part of the shaped product (13) which has been already reinforced, so that mechanical strength, wear resistance, heat resistance and the like of such crown surface becomes worse than expected. In addition, since the crown surface has been reinforced with short fiber ceramics or the like, machinability of the resulting product is very poor and hence, wear and tear of cutting tools are increased.

Accordingly, the present invention has been made to solve the problems in these conventional methods. In this connection, in the present invention it is noticed that a piston generally has a piston pin cavity into which the piston pin is to be inserted and such piston pin cavity is defined in the machining process after the casting process, and hence there is no problem if a portion of a piston corresponding to the piston pin cavity thereof presents a concave form, so that such concave form is utilized for absorbing scattering of molten metal poured.

SUMMARY OF THE INVENTION

Accordingly, an object of the present invention is to provide a method for manufacturing a ceramic reinforced piston and a molding machine therefor in which an amount pushed out by push rams forms a cavity for a piston, scattering of molten metal poured is absorbed by utilizing a condition of such cavity so that a crown surface of the piston is formed with a constant prescribed thickness A—A, whereby no machining is required for the crown surface and mass production of ceramic reinforced pistons become possible.

In accordance with the method for manufacturing a ceramic reinforced piston and a molding machine therefor which realizes the above described object, either ceramic particles or a shaped inorganic short fiber, which has been previously heated is suitably introduced into or placed in a prescribed position in a heated casting mold, a molten metal such as aluminum alloy and the like is poured in the casting mold to keep an upper punch at a prescribed position, and furthermore push rams which are freely inserted in and out of a mold main body at the position corresponding to a piston pin cavity are suitably pushed out to solidify the molten metal in the casting mold while pressurizing the molten metal.

BRIEF DESCRIPTION OF THE DRAWINGS

Embodiments of the invention will now be described, by way of example, with reference to the accompanying drawings, in which;

FIG. 1 is a sectional view showing a conventional prior art molding machine;

FIG. 2 is a sectional view showing the molding machine according to the present invention;

FIG. 3 is a sectional view illustrating a state where a ceramic reinforced piston is manufactured in accordance with a conventional method;

FIG. 4 is a graph showing the contents of a heat-fatigue resistance test; and

FIG. 5 is a sectional view illustrating a state where a ceramic reinforced piston is manufactured in accordance with the manufacturing method according to the present invention.

DETAILED DESCRIPTION OF THE PREFERRED EMBODIMENTS

In order to more fully explain the present invention, the invention will be described with reference to the accompanying drawings.

First the molding machine according to the present invention will be described. In the drawing, reference numeral (1) designates a die holder for forging molten metal, and (2) designates a block-like mold main body. Reference numeral (3) designates an upper punch disposed above the mold main body (2) and the upper punch (3) is movable up and down by means of a press machine (not shown). Reference numeral (4) designates a disc-shaped knock-out die disposed internally at the lower part of the mold main body (2). Reference numeral (5) designates a knock-out device having a suitable mechanism (not shown) provided with a knock-out pin (5*a*) movable up and down and disposed below the knock-out die. (6) designates a pair of push rams each corresponding to the position of a piston pin cavity and each being freely movable in and out of the interior of the mold main body (2) in the lateral direction thereof. (7) designates a pair of pedestals installed vertically on and fixed to the die holder (1) to fix the same. The pedestals are suitably spaced from the mold main body (2), and these pedestals (7) are used for installing the push rams (6) on the mold main body (2). (8) designates an insulating material applied on the surface of the pedestal (7) on the side facing the mold main body (2). (9) designates a receiving plate secured to the upper part of the mold main body (2), and the receiving plate (9) functions as a stopper for the upper punch (3). (10) designates a press machine for the push rams (6). (11*a*) designates an actuation adjusting means and this means (11*a*) comprises an actuation adjusting means main body (11*a*) secured to the upper part of the pedestal (7), a connecting rod (11*b*) connecting said actuation adjusting means main body (11*a*) with a push ram (6), and a connecting line (11*c*) connecting said actuation adjusting means main body (11*a*) with the press machine (10). Reference numeral (12) designates a fastening member composed of a bolt or the like, and (13) designates a shaped fiber for reinforcing a piston.

Next, the manufacturing method according to the present invention will be described. First, either alumina particles consisting of 100% $\alpha$-alumina and having an average particle diameter of 63 $\mu$m which has been heated to 800° C. in a crucible made of an inorganic material, or the shaped fiber (13), having a thickness of 10 mm and heated to 700° C., which has been shaped from an alumina short fiber material having an average diameter of 3 $\mu$m and an average length of 0.7 mm, is thrown into or set in a casting mold defined between the mold main body (2) and the knock-out die (4), which has been previously heated to 300° C. Thereafter, a molten JIS-AC8A alloy (14) is poured into the casting mold at 750° C. in an amount somewhat smaller than a conventional amount. In this case, it is desirable that a temperature to which said particles or shaped inorganic short fiber (13) is to be heated is higher than the melting point of the aluminum alloy, but 800° C. or less.

Immediately after pouring the molten metal, the upper punch (3) is lowered until it abuts against the receiving plate (9). At the same time of stopping the upper punch (3), the pair of push rams are pushed out from the lateral direction of the mold main body (2) corresponding to the position of the piston pin cavity inside towards the molten metal (14). In this case, a second applied pressure of the push rams (6) is set somewhat smaller than that of a first applied pressure of the upper punch (3). Thus, the pressure of the molten metal (14) in the casting mold is elevated by means of the push rams (6) so that the push rams (6) are pushed out until the pressure reaches a prescribed pressure. As a result, the molten metal (14) permeates sufficiently into the reinforced portion of the particles or shaped fiber (13). An inserted length of the push rams (6) forms a concave portion of the piston pin cavity and hence, the piston is cast in the best condition, where scattering of the molten metal (14) poured is absorbed dependent upon a depth of the concave portion. The applied pressure in this case differs depending upon whether the particles are used or the shaped fiber (13) is employed. In this connection, the applied pressures of the upper punch (3) and of the push rams (6) are 950 kg/cm$^2$ and 800 kg/cm$^2$, respectively, in the case of particles, whilst such applied pressures of the upper punch (3) and that of the push rams (6) are 1100 kg/cm$^2$ and 840 kg/cm$^2$, respectively, when using the shaped fiber (13). The timing for pushing out the push rams (6) may be before or at the same time of pouring such molten metal. In such a case, since the applied pressure of the push rams (6) is small with respect to the upper punch (3), the push rams (6) which have been projected into the molten metal are returned automatically towards the direction of the mold main body (2) by means of the pressure of the molten metal pressurized by the upper punch (3) until the pressure of the molten metal reaches a prescribed value.

In these circumstances, the upper punch (3) and the push rams (6) continue the pressurization until solidification of the molten metal (14) is completed. After solidification, the upper punch (3) is returned to the original position above the mold main body (2) and further, the push rams (6) are also restored to the former state. In this case, the connecting rod (11*b*) secured to the push rams (6) is also returned so that one end of the connecting rod (11*b*) pushes the actuation adjusting means main body (11*a*), whereby the driving of the press machine (10) is stopped. The extreme end of a push ram (6) is in a state somewhat retracted from the inner surface of the mold main body (2). Thereafter, the knock-out pin (5*a*) of the knock-out means (5) is pushed up, and the knock-out die (4) is also pushed up in response thereto whereby a cast piston is taken out.

Next, a ceramic reinforced piston manufactured in accordance with the manufacturing method and machine therefor according to the present invention will be compared to that manufactured in accordance with a conventional manufacturing method by means of cutting work with respect of heat-resisting heat-fatigue.

EXAMPLE OF HEAT-FATIGUE RESISTANCE TEST

The ceramic reinforced piston according to the manufacturing method of the present invention was compared with that according to a conventional manufacturing method as per the following manner. Heat-fatigue resistance test was repeated in accordance with the testing method shown in FIG. 4 as one cycle (=60 sec.) in the heat-fatigue resistance test process in which the test was continued until cracks appeared initially on the crown surface of a ceramic reinforced piston tested, and the results of the test are shown by the number of cycles in the following Table.

It is to be noted that a reinforced piston according to a conventional manufacturing method used in the test has been machined such that a thickness A—A of the crown surface of the piston was reduced by 2 mm with cutting in order to obtain a prescribed dimension of the piston.

| | Experimental Results | |
|---|---|---|
| Items | Piston of the Invention | Piston of Prior Art |
| Distance between A-A | 15 mm | 15 mm |
| Thickness of Composite Material Layer | 10 mm | 8 mm |
| Number of Cycles Until Cracks Appear on Crown Surface of Piston | 6583 | 4542 |

Since the reinforced piston according to the manufacturing method of the present invention can be formed with a predetermined thickness A—A of the crown surface, in other words, it requires no cutting work, the heat-resisting fatigue strength thereof can be remarkably improved as much as 1.5 times in comparison with that of a conventional one, and in addition a cast product with good precision could be manufactured.

As described above, according to the method for manufacturing a ceramic reinforced piston and the molding machine therefor of the present invention, scattering of the molten metal (14) poured is absorbed, and furthermore internal defects in a casting mold used can be substantially eliminated by solidifying the molten metal (14) while pressurizing the same, so that a thickness A—A of the crown surface of the ceramic reinforced piston can be formed with high precision because no machining process is necessary in this case. Accordingly, mechanical strength, wear resistance, heat-resistance and the like of such piston are improved, and in addition, mass production of the ceramic reinforced piston becomes possible. The present invention is also suitable for manufacturing an ordinary metallic piston which has not been reinforced with ceramics and the like.

Although the particular embodiments of the invention have been shown and described, it will occur to those with ordinary skill in the art that other modifications and embodiments exist as will fall within the true spirit and scope of the invention as set forth in the appending claims.

I claim:

1. A method of casting an article, comprising the steps of:

providing a mold having a main body with at least one side wall, at least one opening extending through said side wall, a bottom wall for said mold connected thereto to thereby define a mold interior, an upper punch movable from a raised position spaced from said mold to a lowered position abutting said mold to constitute a top wall of said mold, and at least one push ram respectively movably mounted in said at least one opening, said at least one push ram being movable from a retracted position spaced from said mold interior to an outermost position extending into said mold interior;

placing said at least one push ram in said outermost position;

during or subsequent to said step of placing said at least one push ram in said outermost position, inserting a quantity of molten metal into said mold interior with said upper punch in said raised position;

lowering said upper punch to said lowered position and maintaining said upper punch in said lowered position by application of a first pressure on said upper punch;

applying a second pressure to said at least one push ram to arrest, at an extended position between said outermost and said retracted positions, movement of said at least one push ram from said outermost position toward said retracted position, said movement being caused by fluid pressure exerted on said at least one push ram by the molten metal, said first pressure being greater than said second pressure, and said at least one push ram in its extended position reducing the volume of said mold interior by an amount whereby the molten metal is pressurized within a prescribed pressure range;

allowing the molten metal to solidify;

raising said upper punch to said raised position and moving said at least one push ram to said retracted position; and removing said article from said mold.

* * * * *